United States Patent [19]

Laverman et al.

[11] Patent Number: 4,543,978

[45] Date of Patent: Oct. 1, 1985

[54] SINGLE TANK FOR DUAL THERMAL ENERGY STORAGE WITH INTERNAL MOVABLE PARTITION

[75] Inventors: Royce J. Laverman, South Holland; Luciano F. Bertolazzi, Wheaton, both of Ill.

[73] Assignee: Chicago Bridge & Iron Company, Oak Brook, Ill.

[21] Appl. No.: 516,594

[22] Filed: Jul. 25, 1983

[51] Int. Cl.[4] ..... E03B 11/00

[52] U.S. Cl. ..... 137/255; 220/22

[58] Field of Search ..... 220/22, 22.1, 22.2; 92/121, 123, 124, 125, 144, 169; 137/255, 256, 257, 258, 259, 262, 264; 60/659; 49/40, 41, 43.96

[56] References Cited

U.S. PATENT DOCUMENTS 2,413,751 1/1947 Dennis ..... 92/144
3,438,215 4/1969 Frijlink ..... 220/22

FOREIGN PATENT DOCUMENTS 1351481 12/1962 France ..... 92/125
37114 4/1923 Norway ..... 92/144

*Primary Examiner*—Martin P. Schwadron
*Assistant Examiner*—John S. Starsiak, Jr.
*Attorney, Agent, or Firm*—Marshall, O'Toole, Gerstein, Murray & Bicknell

[57] ABSTRACT

A liquid storage tank for storing a dual temperature liquid comprising an enclosed tank which is circular in horizontal section; a vertical radial stationary partition in the tank; a vertical radial partition in the tank rotatably movable about the vertical axis of the tank; a seal preventing liquid flow between opposite sides of the movable partition and opposite sides of the stationary partition; an opening for feeding a liquid to a first side of the stationay partition and withdrawing liquid therefrom; and an opening for feeding a liquid to a second side of the stationary partition and withdrawing liquid therefrom.

15 Claims, 7 Drawing Figures

SINGLE TANK FOR DUAL THERMAL ENERGY STORAGE WITH INTERNAL MOVABLE PARTITION

This invention relates to liquid storage tanks. More particularly, this invention is concerned with a tank for physically separably storing variable volumes of a liquid at different or dual temperatures.

BACKGROUND OF THE INVENTION

Quite often industrial operations require simultaneous storage of a liquid in both relatively hot and relatively cold forms. It is common to use separate tanks for this purpose. One tank stores the hot liquid and the other tank stores the cold liquid.

To minimize capital investment, it has been previously proposed to store the same liquid at dual temperatures in one tank and to rely on specific gravity to maintain a hot volume above a lower cold volume. See Schmitt et al U.S. Pat. No. 4,315,404 in which a tank stores hot water above cold water, the cold water being used in peak shaving in an electrical generating plant.

Not only is cold water, or some other liquid, often stored for cooling but, in addition, it is necessary for various hot liquids to be stored to preserve and conserve thermal energy. Owing to a frequent mismatch between production and utilization of such energy, a need exists for its storage. For most practical applications, the storage temperatures could range from 75° F. (24° C.) to about 1050° F. (566° C.).

Thermal energy can be stored in the form of a hot liquid in a single tank if the liquid is to be discarded after its thermal energy is removed. However, if the liquid is to be reheated after its thermal energy is removed, it must be suitably stored for reuse. A separate or cold tank can be used for this purpose but this is expensive. Alternatively, a thermocline storage tank such as described above with the hotter liquid stored on top and the colder liquid at the bottom of the tank, can be used. Although such a tank is useful, particularly with water, there is nevertheless some undesirable mixing between the hot and cold layers when water is fed to or removed from the tank. Furthermore, other liquids otherwise suitable for storing thermal energy do not maintain a sharp thermocline so that effective separation of hot and cold layers is not always possible. A need accordingly exists for alternative means for storing a liquid at dual temperatures and variable volumes.

SUMMARY OF THE INVENTION

According to the invention there is provided a liquid storage tank, such as for storing a dual temperature liquid, comprising an enclosed tank which is circular in horizontal section about a vertical axis; a vertical radial stationary partition in the tank; a vertical radial partition in the tank rotatably movable about the vertical axis of the tank; means preventing liquid flow between opposite sides of the movable partition and opposite sides of the stationary partition; means for feeding a liquid to a first side of the stationary partition and withdrawing liquid therefrom; and means for feeding a liquid to a second side of the stationary partition and withdrawing liquid therefrom.

For storing both hot and cold liquids simultaneously, the tank can be fully thermally insulated.

Although the rotatable or movable partition can be rotated mechanically, it is generally more suitable to have it free wheeling and rotatable by a difference in hydrostatic head on each side of it.

In one embodiment of the invention, a vertical column can be axially positioned in the tank and the stationary partition joined to it. The movable partition, furthermore, can be rotatably connected to the column.

More specifically, the invention provides a liquid storage tank, such as for storing a dual temperature liquid, comprising an enclosed tank having a circular flat bottom, a vertical circular cylindrical wall having a lower end joined to the bottom and an upper end joined to and supporting a roof; a vertical radial stationary partition in the tank having a height about equal to the tank wall height, extending from about the tank center and joined to the tank bottom and wall; a vertical radial partition in the tank having a height about equal to the tank wall height, rotatably movable about the vertical axis of the tank, said movable partition extending from about the tank center to the tank wall; means preventing liquid flow between opposite sides of the movable partition and opposite sides of the stationary partition; means for feeding a liquid to a first side of the stationary partition and withdrawing liquid therefrom; and means for feeding a liquid to a second side of the stationary partition and withdrawing liquid therefrom.

The outer edge of the movable partition can be spaced inwardly of the tank wall and the partition lower edge can be spaced inwardly of the tank bottom. A flexible seal can be positioned between the partition outer edge and the tank wall, and between the partition bottom edge and the tank bottom, to prevent passage of liquid past the partition.

The rotatable or movable partition can be supported by roller means which permits the partition to rotate by a difference in hydrostatic head on each side of it.

In addition to having the tank bottom, wall and roof fully thermally insulated, the stationary and movable partitions can also be insulated.

The tank can include a vertical column axially positioned in the tank to which the stationary partition can be joined and to which the movable partition can be rotatably connected. The rotatable partition can be supported by roller means which permits the partition to rotate by a difference in hydrostatic head on each side of it. The roller means can include means suspending the rotatable partition from the tank wall, and also supporting it from the column and tank bottom.

The movable partition vertical outer edge can have roller means mounted thereon to rollably move in contact with the tank wall.

Each partition can comprise a composite structure having insulation between spaced apart layers of sheet material.

DETAILED DESCRIPTION OF THE DRAWINGS

Figure 1:
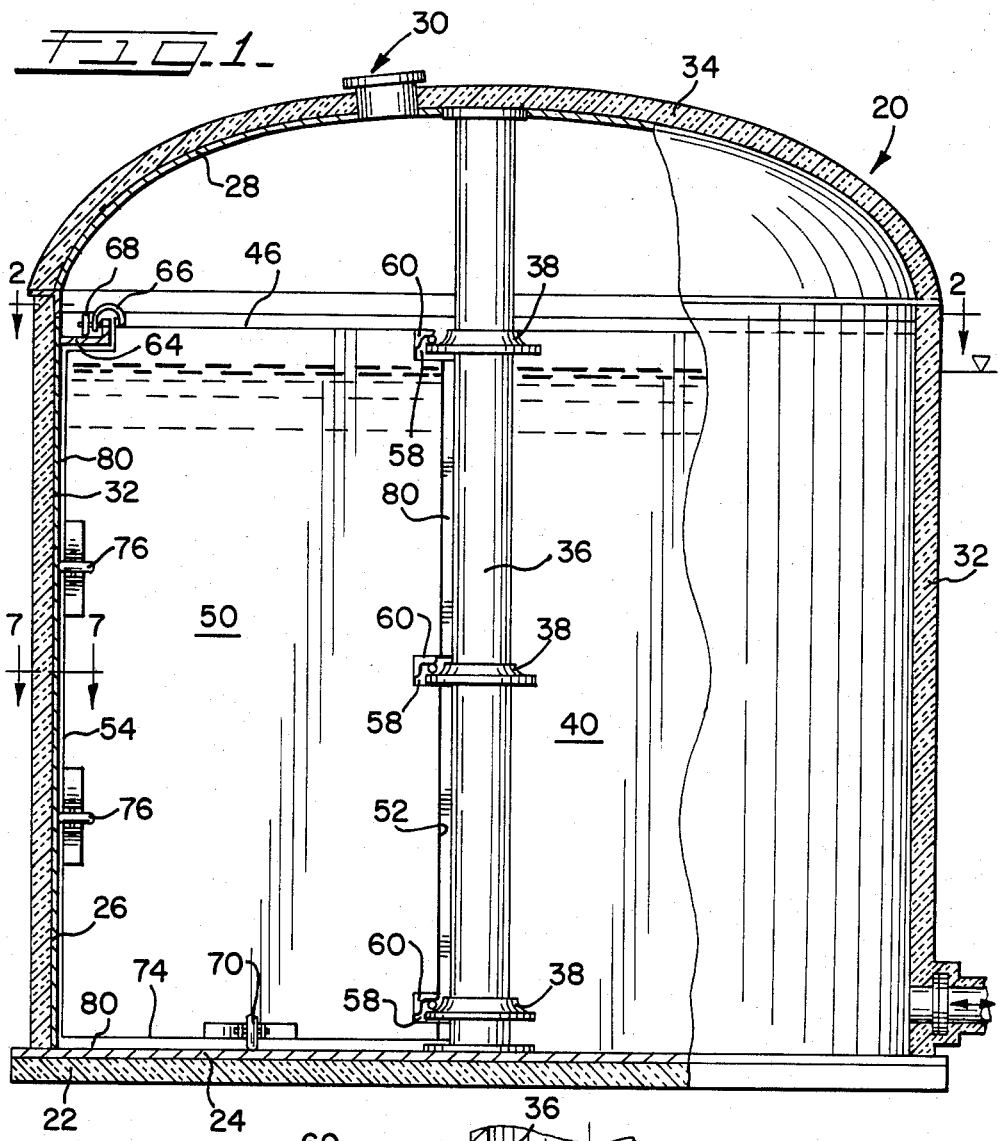
FIG. 1 is an elevational view, partially broken away, of a liquid storage tank according to the invention.

To the extent it is reasonable and practical the same number will be used to identify the same or similar elements or parts in the drawings.

Figure 2:
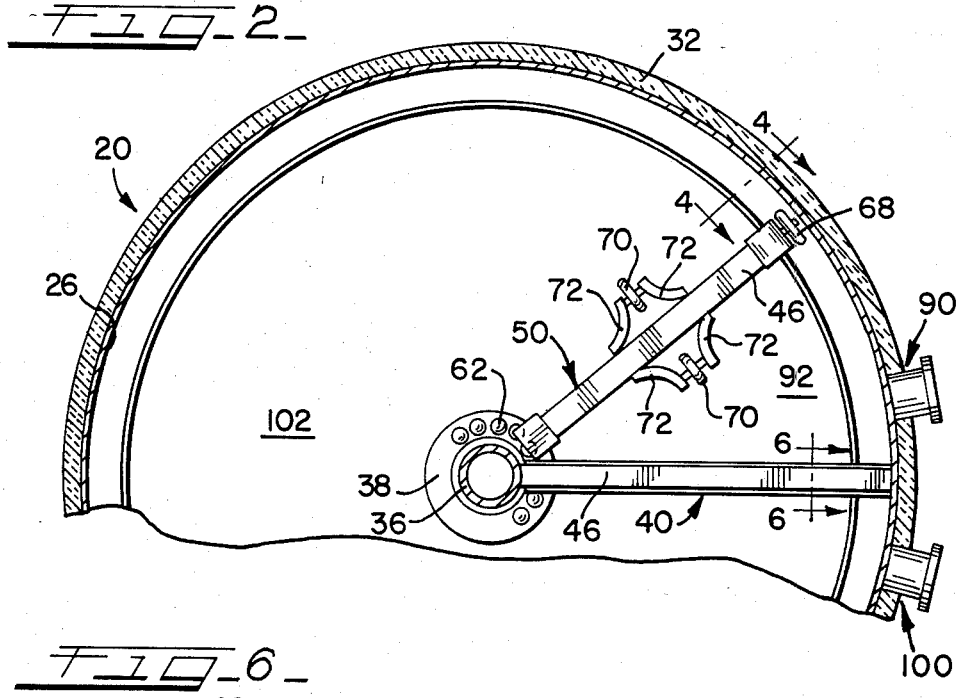
FIG. 2 is a sectional view taken along the line 2—2 of FIG. 1 and shows the stationary partition and the rotatable partition.

With reference to FIGS. 1 and 2, the liquid storage tank 20 is supported on a load bearing insulating concrete foundation 22. Tank 20 has a flat metal circular bottom 24 to which the lower edge of vertical circular cylindrical metal wall 26 is welded. Domed metal circular roof 28 is supported by the upper edge or end of wall 26. Manhole 30 is provided in roof 28 to provide access to the tank interior.

The exterior of wall 26 is covered with thermal insulation 32. Similarly, the exterior of roof 28 is covered with thermal insulation 34. Since the bottom 24 rests on an insulating foundation, the tank is fully insulated.

Vertical tubular metal column 36 is axially positioned in tank 20 and extends from bottom 24 to roof 28. Column 36 supports three vertically spaced apart essentially identical metal bearing rings 38.

A stationary vertical partition 40 extends radially from column 36 to tank wall 26. The stationary partition 40 is joined to the column 36, wall 26 and bottom 24 by any suitable means which effectively prevents flow of liquid past or through the joint. Although stationary partition 40 could be made taller, it is generally better to restrict the height of this partition to about, or slightly less than, the height of tank wall 26 for ease of fabrication.

Figure 6:
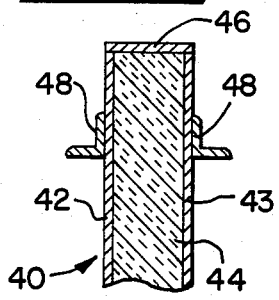
FIG. 6 is a sectional view taken along the line 6—6 of FIG. 2 and shows the composite structure of the rotatable partition.

Although the construction of stationary partition 40 can be varied, it is desirably a fabricated composite insulating structure as shown in FIG. 6. Thus, the sides 42 and 43 can be made of metal sheets with insulation 44 between the sheets. Metal strip 46 can be used to cover the top of the partition 40. Angles 48 can be attached to the sides of the partition to stiffen it.

Figure 3:
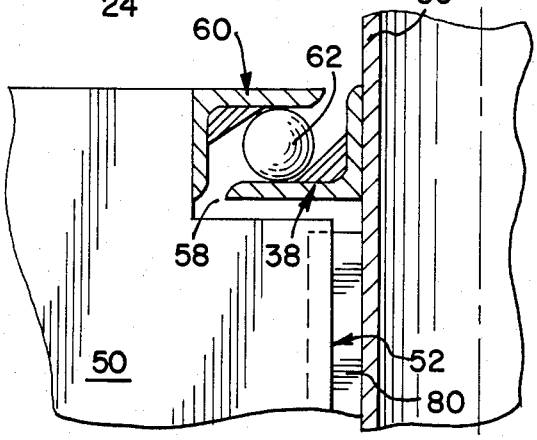
FIG. 3 is an enlarged sectional view of a roller bearing support system for the inner vertical edge of the rotatable partition.
Figure 7:
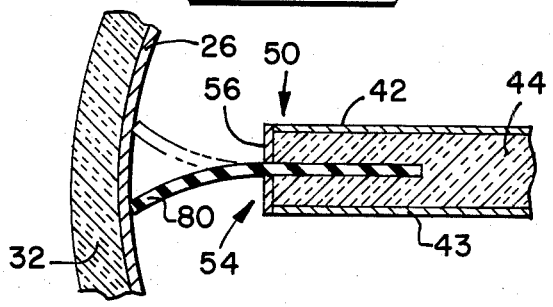
FIG. 7 is a sectional view taken along the line 7—7 of FIG. 1 and illustrates the flexible seal spanning the space between the vertical edge of the rotatable partition and the tank wall.

Tank 20 also contains a radially positioned vertical movable partition 50 which is rotatable about the vertical axis of the tank (FIGS. 1 and 2). The rotatable partition can have the same general composite structure as shown in FIG. 6 for the stationary partition. However, the inner and outer vertical edges 52 and 54 of the rotatable partition are provided with metal strips 56 to protect the insulation and to strengthen the partition (FIGS. 3 and 7). The inner edge 52 has three spaced apart cut out areas 58 which are located adjacent the bearing rings 38 on the column (FIG. 1). Each cut out area 58 contains an upper bearing member 60. Steel balls 62 (FIG. 3) are placed between each ring 38 and bearing member 60. The balls are restrained beneath member 60 by a suitable cage arrangement (not shown).

Figure 4:
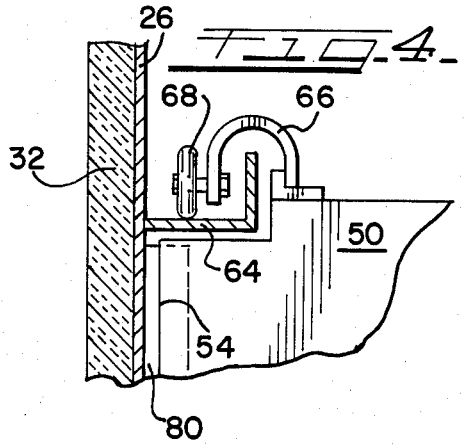
FIG. 4 is a sectional view taken along the line 4—4 of FIG. 2 and illustrates in enlarged view a roller system for suspending the rotatable partition from the tank wall.

Additional support for the rotatable partition can be provided by a roller arrangement at the top of the partition along its outer edge 54. With reference to FIGS. 1 and 4, angle 64 is shown welded to tank wall 26. Roller support arm 66 is joined to the top edge of partition 50. Roller 68 is mounted on the outer end of arm 66 so as to ride on the horizontal web of angle 64, thereby effectively suspending the partition outer portion from the tank wall.

Figure 5:
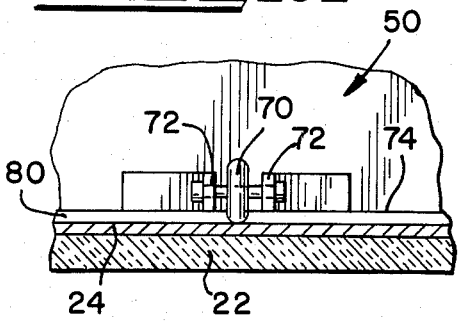
FIG. 5 illustrates a roller system for supporting the bottom edge of the rotatable partition on the tank bottom and which is also useful along the rotatable partition vertical edge to guide it along the tank wall.

Further support for rotatable partition 50 can be provided by one or more rollers 70 mounted on the bottom edge 74 of the partition. The rollers 70 are attached to the partition 50 by brackets 72 (FIG. 5).

It is also considered desirable to provide one or more rollers 76 along the outer vertical edge 54 of the rotatable partition 50 (FIG. 1) to maintain a spaced relationship with the tank wall. The rollers 76, however, are intended to roll in contact with tank wall 26.

The described system of rollers and bearings is intended to illustrate only one arrangement suitable for rotatably mounting the movable partition 50. Some of the rollers and bearings can perhaps be dispensed with at times or they can be supplemented by others if needed to facilitate free wheeling movement of the partition. Also, other completely different support systems can be used, provided they permit the partition to rotate about the tank vertical axis.

The rotatable partition 50 is provided with a gap between its inner edge 52 and column 36, between its outer edge 54 and tank wall 26, and between its lower edge 74 and tank bottom 24. To prevent liquid from flowing through the described gaps, a flexible seal 80 is provided at each such edge of the partition. Thus, a seal 80 extends from inner edge 52 into contact with column 36; a seal 80 extends from outer edge 54 into contact with tank wall 26; and a seal 80 extends from lower edge 74 into contact with tank bottom 24. In each instance the seal 80 can be embedded in the adjacent edge of the partition 50 as shown in FIG. 7. However, the seal 80, desirably in the form of a flexible strip, can be attached to the side of the partition adjoining the edge, whether it be the inner, outer or lower edge of the partition. Similar seals are also provided around the bearings and rollers to retard flow of liquid through those areas.

The flexible seal 80 can be made of any material which is stable under the conditions of use. For low temperature applications a seal such as disclosed in McCabe U.S. Pat. No. 4,138,032 can be used.

The height of rotatable partition 50 is desirably made the same as that of the stationary partition. However, it is important that both partitions have a height above the level of liquid to be stored in the tank plus the hydrostatic head needed to rotate the movable partition.

Tank 20 is provided with a nozzle 90 near the bottom of wall 26 on one side of stationary partition 40 for feeding hot liquid 92 to the tank and removing it therefrom. Similarly, a nozzle 100 is provided near the bottom of wall 26 on the other side of stationary partition 40 for feeding cold liquid 102 to the tank and removing it therefrom.

When it is desired to store thermal energy in tank 20, hot liquid is fed to the tank through nozzle 90. The liquid level between stationary partition 40 and rotatable partition 50 supplied by hot liquid through nozzle 90 is permitted to rise higher than the level of the cold liquid 102 in the tank. The hydrostatic force so developed overcomes the passive resistance of the rotatable partition 50 thereby causing it to rotate to accommodate the increase in hot liquid volume in the tank. At the same time that hot liquid 92 is fed to the tank, cold liquid 102 is withdrawn through nozzle 100. The rate of withdrawal of the cold liquid can be regulated to develop the desired hydrostatic head to cause the partition 50 to rotate. If desired, the cold liquid can be passed through a heat exchanger (not shown) to be heated and then fed to tank 20 as the hot liquid.

The described procedure can continue as long as there is hot liquid to be fed to the tank. In some cases the tank can be completely filled with hot liquid and in other cases only partially filled.

When it is desirable to use the thermal energy of the hot liquid, or simply to cool it for use later for cooling purposes, the hot liquid 92 can be withdrawn through nozzle 90. Simultaneously, it is desirable, although not essential, to feed cold liquid 102 to the tank through nozzle 100. The hydrostatic head needed to rotate the movable partition 50 can be provided by feeding cold water to the tank as described or by relying on withdrawal of hot liquid to create a liquid level differential with respect to the cold liquid in the tank.

The rotatable partition 50 separating the variable volume hot and cold spaces will move automatically due to the changing hydrostatic forces developed by the liquids to maintain an essentially constant liquid level in the tank.

During the described operation of the tank, the hot and cold liquids are kept physically separated, it being understood that the liquid is the same in most instances. Thus, the hot liquid can be water and the cold liquid can be water. However, the tank can also be used to store different liquids at different temperatures. Thus, water can be stored cold on one side, and hot sea water on the other side, of the rotatable partition.

Although the tank 20 will in many cases be most suitably made of metal such as carbon steel, a steel alloy or aluminum, it could also be made of ceramic or polymeric materials.

The foregoing detailed description has been given for clearness of understanding only, and no unnecessary limitations should be understood therefrom, as modifications will be obvious to those skilled in the art.

What is claimed is:

1. A liquid storage tank for storing two separate volumes of liquid at different temperatures, comprising:

an enclosed roofed tank which is circular in horizontal section about a vertical axis;

a vertical radial stationary partition in the tank;

a vertical radial partition in the tank having a top edge out of sealing contact with the roof and means mounting the partition to be rotatably movable about the vertical axis of the tank by a difference in hydrostatic force on each side of said partition;

means preventing liquid flow between opposite sides of the movable partition and opposite sides of the stationary partition;

means for feeding a liquid to a first side of the stationary partition and withdrawing liquid therefrom; and means for feeding a liquid to a second side of the stationary partition and withdrawing liquid therefrom.

2. A liquid tank according to claim 1 in which the tank is thermally insulated.

3. A liquid storage tank for storing two separate volumes of liquid at different temperatures, comprising:

an enclosed tank having a circular flat bottom, a vertical circular cylindrical wall having a lower end joined to the bottom and an upper end joined to and supporting a roof;

a vertical radial stationary partition in the tank having a height about equal to the tank wall height, extending from about the tank center and joined to the tank bottom and wall;

a vertical radial movable partition in the tank having a height about equal to the tank wall height and terminating at the top out of sealing engagement with the roof and extending from about the tank center to the tank wall, and support means mounting the movable partition so that it can rotate about the vertical axis of the tank by a difference in hydrostatic force on each side of the partition;

means preventing liquid flow between opposite sides of the movable partition and opposite sides of the stationary partition;

means for feeding a liquid to a first side of the stationary partition and withdrawing liquid therefrom; and means for feeding a liquid to a second side of the stationary partition and withdrawing liquid therefrom.

4. A liquid storage tank according to claim 3 in which the movable partition has an outer edge spaced inwardly of the tank wall and a lower edge spaced inwardly of the tank bottom;

a flexible seal between the partition outer edge and the tank wall; and a flexible seal between the partition bottom edge and the tank bottom.

5. A liquid storage tank according to claim 3 in which the rotatable partition is supported by roller means which permits the partition to rotate by a difference in hydrostatic head on each side of it.

6. A liquid storage tank according to claim 3 in which the tank bottom, wall and roof are thermally insulated.

7. A liquid storage tank according to claim 6 in which the stationary and movable partitions are insulated.

8. A liquid storage tank according to claim 3 in which each partition comprises a composite structure having insulation between spaced apart layers of sheet material.

9. A liquid storage tank for storing two separate volumes of liquid at different temperatures comprising:

an enclosed tank which is circular in horizontal section about a vertical axis;

a vertical radial stationary partition in the tank;

a vertical radial partition in the tank rotatably movable about the vertical axis of the tank;

a vertical column axially positioned in the tank to which the stationary partition is joined; means for connecting the movable partition to the vertical column, for permitting rotation of the movable partition relative to the vertical column;

means preventing liquid flow between opposite sides of the movable partition and opposite sides of the stationary partition;

means for feeding a liquid to the first side of the stationary partition and withdrawing liquid therefrom; and means for feeding a liquid to a second side of the stationary partition and withdrawing liquid therefrom.

10. A liquid storage tank for storing two separate volumes of liquid at different temperatures comprising:

an enclosed tank having a circular flat bottom, a vertical circular cylindrical wall having a lower end joined to the bottom and an upper end joined to and supporting a roof;

a vertical radial stationary partition in the tank having a height about equal to the tank wall height, extending from about the tank center and joined to the tank bottom and wall;

a vertical radial partition in the tank having a height about equal to the tank wall height, rotatably movable about the vertical axis of the tank, said movable partition extending from about the tank center to the tank wall;

a vertical column axially positioned in the tank to which the stationary partition is joined; means for connecting the movable partition to the vertical column, for permitting rotation of the movable partition relative to the vertical column;

means preventing liquid flow between opposite sides of the movable partition and opposite sides of the stationary partition;

means for feeding a liquid to a first side of the stationary partition and withdrawing liquid therefrom; and means for feeding a liquid to a second side of the stationary partition and withdrawing liquid therefrom.

11. A liquid storage tank according to claim 10 in which the connecting means comprises a first roller means supports the rotatable partition and which permits the partition to rotate by a difference in hydrostatic head on each side of it.

12. A liquid storage tank according to claim 11 including a second roller means suspending the rotatable partition from the tank wall.

13. A liquid storage tank according to claim 11 including roller means supporting the rotatable partition on the tank bottom.

14. A liquid storage tank according to claim 11 in which the movable partition has a vertical outer edge, and a second roller means is mounted at said outer edge to rollably move in contact with the tank wall.

15. A liquid storage tank according to claim 10 in which the column extends from the tank bottom to the tank roof.

* * * * *